United States Patent [19]

Foederer et al.

[11] 4,441,779

[45] Apr. 10, 1984

[54] CONTACT DEVICE FOR A MULTICONDUCTOR CABLE

[75] Inventors: Wilhelmus T. M. Foederer, Best; Francesco G. M. Voorn, Waalwijk, both of Netherlands

[73] Assignee: E. I. Du Pont de Nemours & Company, Wilmington, Del.

[21] Appl. No.: 373,705

[22] Filed: Apr. 30, 1982

Related U.S. Application Data

[63] Continuation of Ser. No. 221,886, Dec. 31, 1980, abandoned.

[51] Int. Cl.[3] ..... H01R 13/39

[52] U.S. Cl. ..... 339/99 R

[58] Field of Search ..... 339/97 R, 97 P, 99, 339/98, 17 F, 176 MF

[56] References Cited

U.S. PATENT DOCUMENTS

| | | | |
|---|---|---|---|
| 3,353,141 | 11/1967 | Budai | 339/99 R |
| 3,816,818 | 6/1974 | Meier | 339/99 R |
| 3,877,771 | 4/1975 | Jensen et al. | 339/99 R |
| 3,963,319 | 6/1976 | Schumacher et al. | 339/99 R |
| 4,262,984 | 4/1981 | Takahashi | 339/97 R |

FOREIGN PATENT DOCUMENTS

| | | | |
|---|---|---|---|
| 2644296 | 4/1978 | Fed. Rep. of Germany | 339/97 P |
| 479961 | 11/1969 | Switzerland | 339/97 R |

*Primary Examiner*—Joseph H. McGlynn

[57] ABSTRACT

A three piece connector comprising a terminal support member supporting a multiplicity of terminals, a cable support member and a terminal cover between the terminal support and cable support. Insulated wire retained between the cable support and terminal cover is pushed down within a recess in the terminal cover to contact an insulation piercing contact of an electrical terminal.

4 Claims, 14 Drawing Figures

Fig. 7
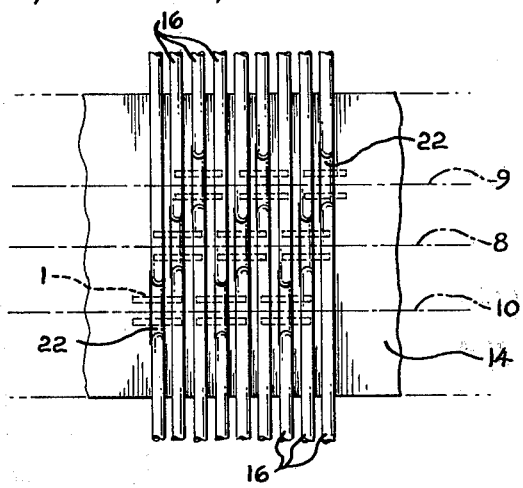
Fig. 8
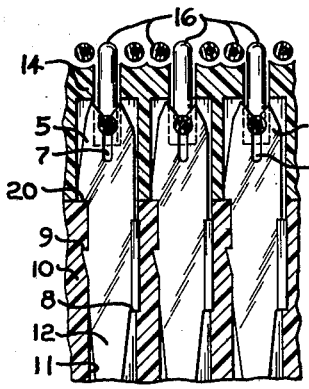
Fig. 10
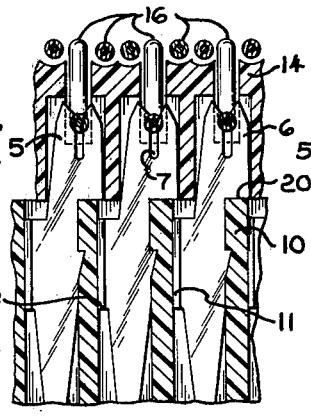
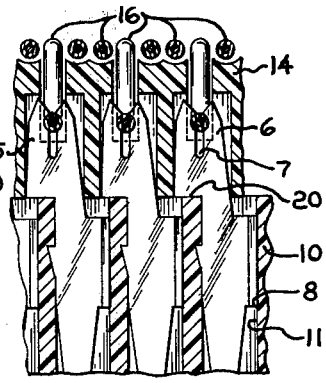
Fig. 9

CONTACT DEVICE FOR A MULTICONDUCTOR CABLE

This is a continuation, of application Ser. No. 221,886 filed Dec. 31, 1980, now abandoned.

BACKGROUND OF THE INVENTION

The invention relates to a contact device for a multiconductor cable comprising a terminal support and a terminal cover of insulating material. The terminal support contains recesses in which terminals are located. Terminals at the side of the terminal cover comprise bifurcated insulation piercing contacts. Insulated electrical conductors of multiconductor cable are passed through the contact cover to the bifurcated insulation piercing contacts.

Said contact device is known from the Dutch patent application No. 7603291, laid open to public inspection. In this known device the insulated electrical conductors are passed through separate bores in the terminal cover, after which the ends are pressed between the tinesof the bifurcated insulation piercing contacts, located in the terminal support. The lower surface of the terminal cover comprises recesses for accommodating the bifurcated insulation piercing contacts, whereas transversely to each recess a deep groove is made for accommodating the bent end of the electrical conductor pressed between the tines of the insulation piercing contact. Upon assembling this contact device each conductor first has to be bent rectangularly at its end to be connected, after which this bent portion is pressed between the tines of the corresponding insulation piercing contact. The free end of the electrical conductor is passed through corresponding bores in the terminal cover, which cover then is slid over the core piercing contacts and lowered on the terminal support upon pulling the ends of the conductors extending out of the bores.

Using a multitude of conductors to assemble such a contact device is time-consuming. This contact device does not lend itself to automatic assembly processes. If one of the connectors has to be repaired or replaced, the terminal cover has to be removed, the conductor has to be replaced and the terminal cover has to be positioned again. As a matter of course the remaining conductors may be damaged or torn apart in this repairing process.

SUMMARY OF THE INVENTION

The above disadvantages are avoided in the contact device of the present invention which is characterized in that the insulated electrical conductors contacting the terminals have been bent in a U-shape over a part of their length and are supported. The base portion of the U-shaped bent conductor is pushed into the slit between the tines of the bifurcated core piercing contact in order to achieve electrical contact with the terminal.

The use of a supported, U-shaped bent conductor portion provides a means of contacting the conductor with the bifurcated insulation piercing contact without passing the conductor separately through a terminal cover. This can be achieved simply by pressing the conductor down between the tines of the bifurcated insulation piercing contact through an opening or recess. The U-shape offers a good strain relief, which can be improved by additional pressing means. Repair or replacement of the conductors can be done very easily since these conductors need not be passed separately through the terminal cover.

In a preferred embodiment of the contact device of the present invention the cover contains recesses for accommodating and supporting the U-shaped bent conductor portions. These recesses are located such that all U-shaped bent conductor portions are positioned in parallel planes. The cover also contains channels for the bifurcated core piercing contacts. These channels emerge into the recesses for the U-shaped bent conductor portions.

Preferably the recesses in the terminal cover for the U-shaped bent conductor portions extend from the upper surface almost to the lower surface of the terminal cover. The channels for the bifurcated core piercing contacts consist of slots extending transversely to the longitudinal direction of the recesses for the U-shaped bent connector portions. In an assembled contact device a bifurcated insulation piercing contact in a slot is squeezed until within the recess. In the recess both sides of the bifurcated insulation piercing contact are sufficiently spaced from the walls of the recess so that there is room for pushing between the tines of this bifurcated insulation piercing contact a portion of an insulated electrical conductor which was passing lengthwise over the recess on the upper surface of the terminal cover.

Upon assembling the contact device of the present invention, first the terminal cover is lowered on the terminal support containing the inserted terminals. The bifurcated insulation piercing contacts are first received by the slots in the terminal cover. The contacts thereafter emerge at the upper surface of the cover within a recess. Next the electrical conductors are placed on the upper surface of the terminal cover in the longitudinal direction across the recesses. Thereafter these conductors can be pressed successively and separately, but also simultaneously into the recess between the tines of the bifurcated insulation piercing contacts. This can be executed with separate tooling formed as a flat strip-shaped anvil, which can press the portion of a conductor stretching across the recess into this recess until in the slit between the two tines. The insulation is cut by the sharp edges of the tines and the core is brought into contact with these sharp edges. Also the pressing action on the conductors can be executed simultaneously for all conductors by means of the cable support. This support consists of a plate having a lower surface resting upon the insulated electrical conductors which in turn rest upon the upper surface of the terminal cover. In this lower surface parallel grooves adjacent to each other are formed for at least partly receiving the electrical conductors. Conductor pushing means are located in the grooves of the cable support, opposite to a recess in the terminal cover. Said conductor pushing means each consist of a finger or a strip portion stretching in the direction to the terminal cover, the largest width of which extends transversely to the plane of the bifurcated insulation piercing contact located in the recess. The length and position of each strip portion is chosen such, that upon lowering the cable support on the terminal cover each strip portion can be conducted into the slit between the tines of the bifurcated insulation piercing contact. Upon lowering the cable support on the terminal cover simultaneously all conductors are pressed between the tines of the terminal. Preferably a clamp is used in order to keep the cable support in position. This clamp may be built in, for instance, or form a part of the usual dust cover for the contact device.

The contact device of the present invention is particularly suitable for automatically operating assembling means. In case a conductor has to be repaired or replaced only one conductor needs to be handled. With the exception of the cable support all remaining portions of the contact device can remain in position. The contact between each core and corresponding bifurcated insulation piercing contact is maintained, even when the cable support is removed. Bending each conductor several times for pushing it into the recess of the cover and between the tines of the insulation piercing contact results in a U-shaped bend in the conductor, which by its position in the terminal cover gives a strain relief. This strain relief can be improved by lowering the cable support, which is clamped on the upper surface of the terminal cover. The lower surface of the cable support and the upper surface of the terminal cover may comprise parallel grooves adjacent to each other for at least partly receiving the electrical conductors.

In contact devices for multiconductor cables there is a tendency to an ever increasing density of the connections, i.e., an ever increasing number of connectors and terminals per contact device. Increasing the density in the above mentioned known contact devices also increases the assembly and repair problems. The usual dimensioning of such contact devices, in which the distance between the center lines of the recesses is for instance equal to 2.54 mm (0.1 inch) and the number of recesses positioned behind each other in one row is three. This constitutes a limit for the number of terminals to be used in one contact device. The length also has to be within certain dimensions, particularly if all conductors have to be supplied from one side to the contact device as is customary with flat cable. In the known devices it is customary to introduce the conductors from above or from different opposite sides to the upper surface of the terminal support.

This problem is solved likewise by the contact device of the present invention, which is characterized in having one row of recesses positioned behind one another in the terminal support. Terminals in the terminal support have different distances between the center line of the terminal and the slit between the tines of the bifurcated insulating piercing contact. Terminals having an offset between the slit and their center line are mutually turned with respect to each other 180°.

In case of three recesses, one behind each other, in one row a central terminal can be used, the slit of which coincides with the center line of this terminal, whereas the outer terminals have slits offset with respect to its center line and are rotated 180° with respect to one another. With the above mentioned dimensioning in this case three conductors can be supplied from one side of the contact device to the upper surface of the terminal cover.

THE DRAWINGS

The invention will now be further explained with reference to the drawings, in which:

FIG. 7 shows a top view of the terminal cover of the contact device of FIG. 2 with insulated electrical conductors laid upon the cover;

FIGS. 8, 9 and 10 show cross sections of the assembled contact device of FIG. 7 across the respective three terminals positioned behind each other in one row;

DESCRIPTION OF THE INVENTION

Figure 5:
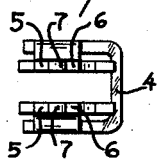
FIG. 5 shows a top view of the terminal of FIG. 3.

Each terminal consists of an upper portion 1, an intermediate portion 2 and a lower portion 3. The terminal may consist of a U-shaped bent electrically conducting sheet. The two parallel sides of this bent sheet are elongated above and below and connected with one another by means of the connection strip 4 in the intermediate portion 2. The elongated upper portions constitute the bifurcated insulation piercing contacts, each consisting of a pair of upstanding tines 5 and 6 respectively, separated from one another by a slit 7. The edges of the tines 5 and 6 defining the slit 7 are sharpened such that upon pressing an insulated conductor from above into the slit 7 the insulation will be cut and the sharp edges of the slit 7 will dig into the core of the electrical conductor. This results in an extremely reliable contact between the core and the terminal.

Figure 4:
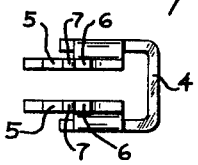
FIG. 4 shows a top view of the terminal of FIG. 2.
Figure 1:
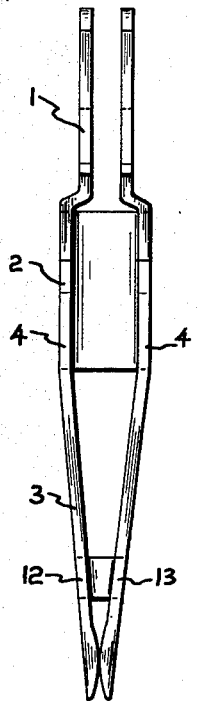
FIG. 1 shows a side elevation of an example of a terminal of the present invention.
Figure 6:
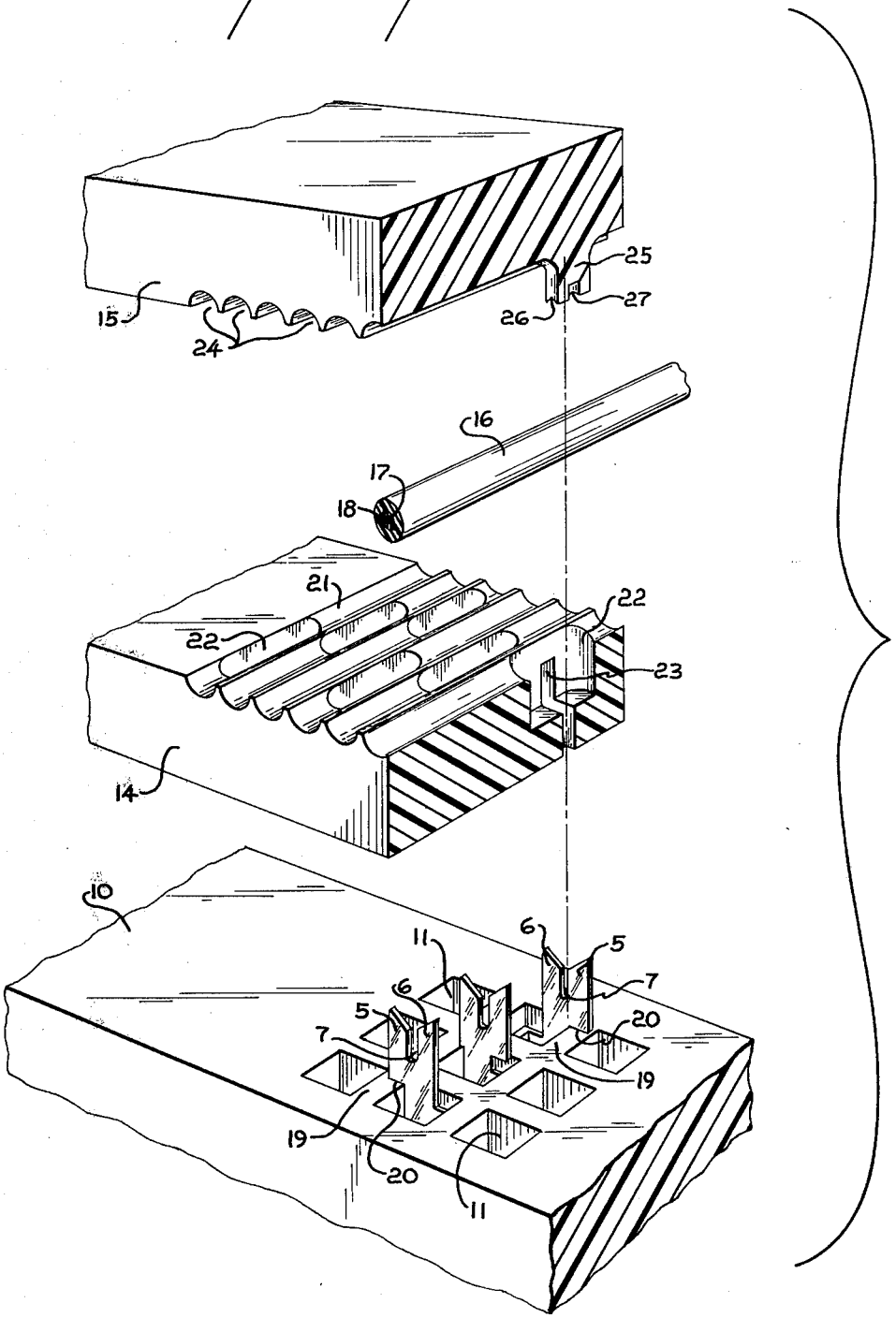
FIG. 6 shows an embodiment of a contact device of the present invention in exploded view.
Figure 12:
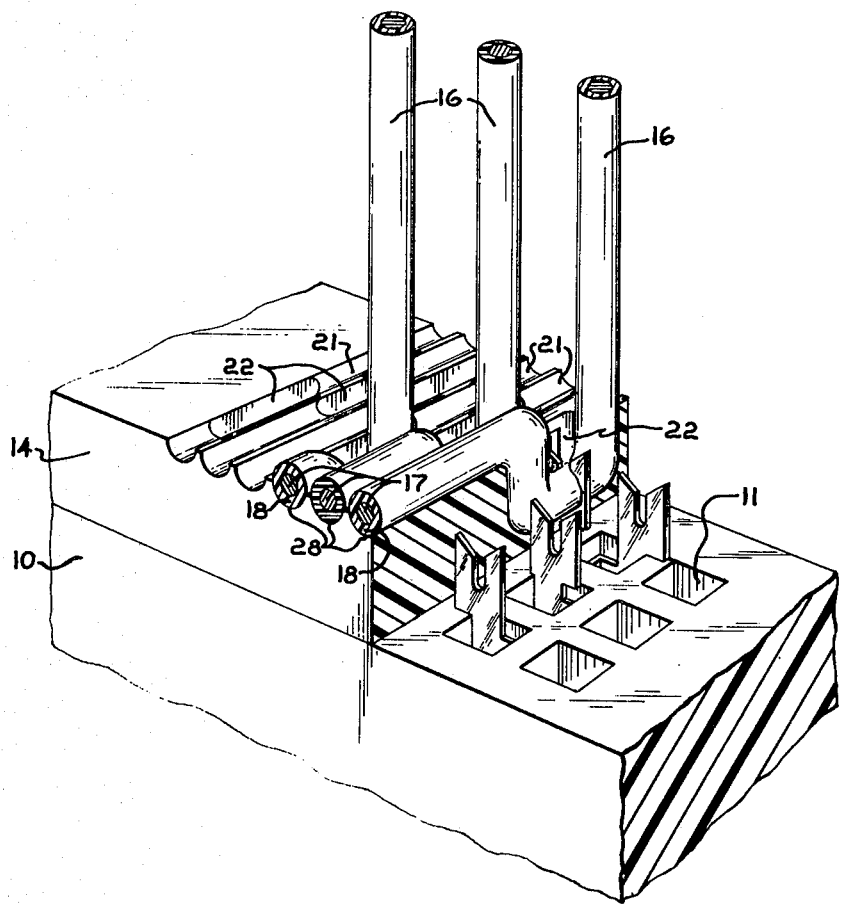
Figure 13:
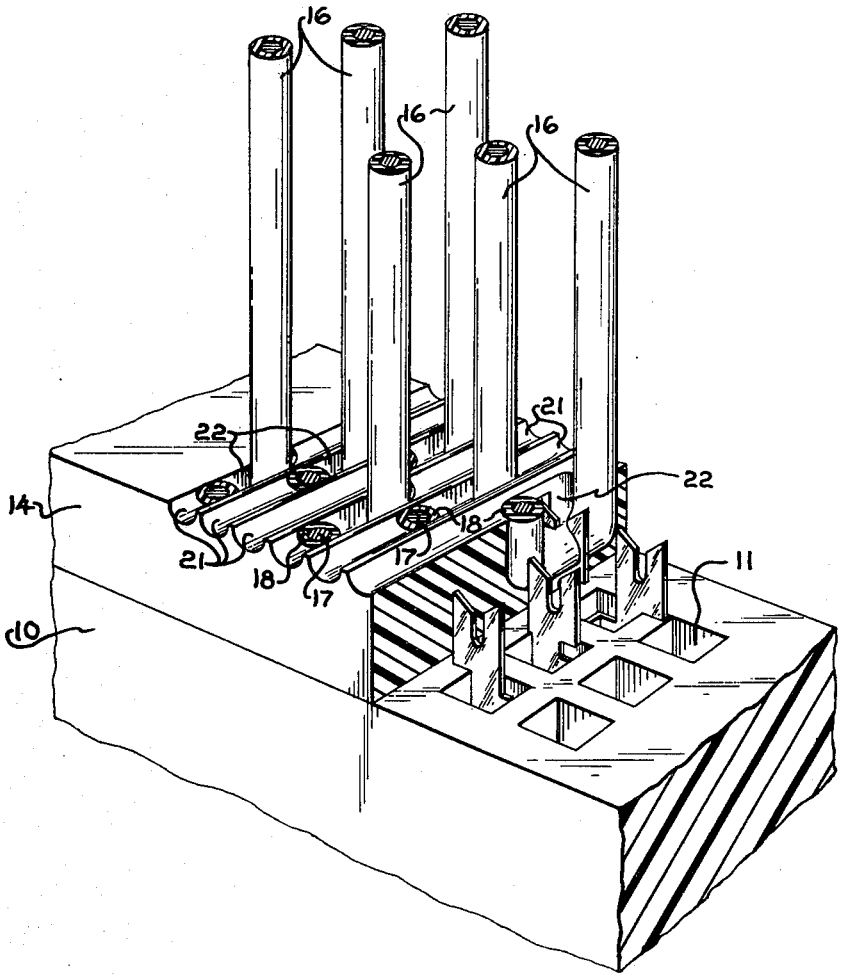

FIGS. 1, 4 and 5 show in the upper portion two parallel bifurcated insulation piercing contacts. For each terminal one or more bifurcated insulation piercing contacts can be used, however, in the present invention usually two bifurcated insulation piercing contacts are used. FIGS. 6, 12 and 13 show as an example one bifurcated insulation piercing contact per terminal. In FIG. 1 two insulation piercing contacts per terminal are used.

The connection strip 4 of the intermediate portion 2 is offset to the right over a predetermined distance with respect to the right-hand edge of the side surfaces, so that a shoulder or support base 8 is obtained. Upon positioning a terminal in the terminal support 10 this shoulder will come to rest on a cam in the recesses 11 of the terminal support 10. At the opposite edge of the intermediate portion 2 a sharp protruding barb 9 is formed, which upon positioning in the recess 11 will dig in the material of the side of the opening, so that the terminal cannot be drawn or fall out of the recess.

The lower portion 3 of each terminal comprises two contact terminals 12, 13 approaching each other for connecting a further conductor. These contact terminals as a matter of course need not be embodied as shown and also may form part of the intermediate portion 2.

Figure 3:
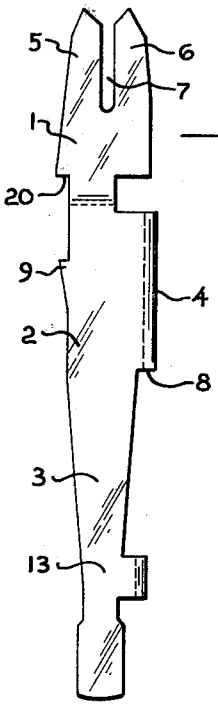
FIG. 3 shows an example of a modified terminal for the contact device of the present invention also rotated over 90° with respect to the side elevation of FIG. 1.
Figure 2:
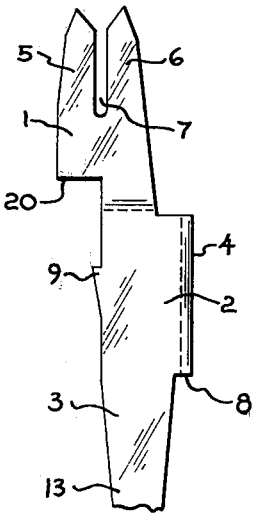
FIG. 2 shows the terminal according to FIG. 1 in side elevation rotated over 90° with respect to the side elevation of FIG. 1.

The difference between the terminals of FIGS. 2, 4 and FIGS. 3, 5 respectively is that the bifurcated core piercing contacts in the terminal of FIGS. 2 and 4 are displaced with respect to the center line of the intermediate portion 2. The slit 7 in FIG. 2 is situated to the left with respect to the center line over a distance determined by the diameter of the used electrical conductors. Upon positioning these terminals in the terminal support 10 one pair of each set is turned over 180°, so that the bifurcated insulation piercing contacts are displaced to the left or to the right with respect to the longitudinal direction of each row of recesses 11. By using a further terminal, the bifurcated insulation piercing contacts of which are not displaced with respect to the center line, as shown in FIGS. 3 and 5, a higher connection density can be obtained in the present invention.

The shape of the intermediate portion 2 is so adapted to the shape of the recesses 11, that the terminal fits closely in these recesses. In FIG. 6 these recesses are shown having rectangular cross sections. In this case the cross section of the intermediate portion 2 will be likewise rectangular. This can be seen in FIG. 6.

FIG. 6 shows the component portions of a contact device of the present invention in an exploded view. The device consists of the terminal support 10, the terminal cover 14 and the cable support 15. The component portions 10, 14 and 15 are drawn above one another, such that upon lowering each portion will take the necessary mutual position. Between the cable support 15 and the terminal cover 14 an electrical insulated conductor to be connected is shown having an insulating sheeth 17 and a core 18.

The terminal support 10 consists of a plastic block having three rows of equi-spaced square or rectangular recesses 11 in this shown embodiment. The pitch between these recesses, which means the distance between the center lines of the recesses 11 which are placed behind each other and next to each other is as usual in this kind of contact devices 2.54 mm or 0.100 inch. This measure is mainly standardized and is used in the U.S.A. and in Europe. Between the recesses 11 lands 19 are formed, having equal width, as long as the recesses 11 are of a rectangular cross section. The upper surfaces of these lands function as support for the terminals as shown in FIG. 1, where the shoulders 20 rest upon the upper side of the lands 19 between the recesses 11.

Terminals according to FIGS. 2 and 3 are positioned in the middle row of the shown recesses, which row is parallel to the direction of grooves 21 in the terminal cover 14. In the center opening a terminal according to FIG. 3 is introduced, whereas at both sides hereof terminals according to FIG. 2 are turned 180° with respect to each other. Upon introducing these terminals in the recesses 11 the barbs 9 dig in the material of the walls between the recesses, so that the terminals are kept firmly in position. The recesses in FIG. 6 are of square cross section, however, the invention is not restricted to this cross section. The cross section likewise can be circular or elliptical, in which case as a matter of course the intermediate portions 2 of the terminals have to be adapted to this modified cross section, such that the terminals cannot rotate in the recesses about their center lines.

In FIG. 6 the terminal cover 14 is shown partly in cross section above the terminal support 10.

The cover 14 is provided at the upper side with parallel grooves 21 having such cross section that the round outer surface of each conductor is supported over a part of the periphery. Three parallel grooves 21 are positioned within the distance between two recesses 11, seen transversely to the direction of the grooves.

A recess 22 emerges into each groove 21. A channel or slot 23 emerges in the lower end of the recess 22. Slot 23 emerges also in the lower surface of the terminal cover 14. In FIG. 6 upon lowering the terminal cover 14 on the terminal support 10 the slot 23 receives the bifurcated insulation piercing contact which forms part of the terminal positioned at the most right side in a recess of the terminal support 10. The recess 22 is of such depth that the upper parts of the two tines 5 and 6 together with slit 7 in between are received in the recess 22, sufficiently high in order to obtain a good contact between core 18 of conductor 16 after pushing down a conductor portion in the recess 22 and between the tines 5 and 6. In FIG. 6 the recess 22 is of angular shape at the bottom. However, this bottom can also be rounded.

Upon assembling the contact device of the present invention, first the terminals are positioned in a manner shown in the recesses 11 of the terminal support 10. In FIG. 6 three of the recesses are filled only, but it will be obvious that the invention is not restricted to this shown example. Next the terminal cover 14 is lowered on the upper surface of the terminal support 10 upon which all bifurcated insulation piercing contacts will slip into the corresponding slots 23.

Next conductors 16 are laid in the grooves 21, which conductors 16 in any case have to extend over the recesses 22, in which at both sides sufficient length remains in order to completely fill the recess 22 with the U-shaped bent portion of this conductor 16 upon pressing in the recess. See also FIGS. 11, 12 and 13. After applying all necessary conductors the cable support 15 is pressed on the upper surface of the terminal cover 14. The cable support 15 also is provided with parallel grooves 24, which together with grooves 21 in the terminal cover 14 will pinch in the electrical conductor 16. In each groove 24 of the cable support 15 a striplike anvil 25 is formed. This anvil is made of the same materials as the cable support 15. Upon lowering the cable support 15 on the terminal cover 14 each anvil 25 is conducted into a corresponding recess 22. The front of the anvil 25 forms a rounded hollow cylindrical support surface 26 for the insulting sheeth 17 of conductor 16. In the middle each anvil comprises an opening 27, having such width that the two remaining pads at both sides of the opening 27 will take a position at both sides of the slit 7 in the bifurcated insulation piercing contact. If a conductor 16 is placed on the groove 21 of the terminal cover, which conductor 16 runs over the recess 22, this part of the conductor 16 on top of recess 22 will be pressed downwardly and between the tines 5 and 6 of the bifurcated insulation piercing contact upon lowering the cable support 15 on the terminal cover 14, so that the core 18 is introduced in the slit 7 after cutting insulation 17 by tines 5 and 6. This results in an excellent electrical contact between the core 18 and the terminal.

The above shows, that upon lowering the cable support 15 on cover 14 all conductors 16 in grooves 21 nearly simultaneously will be brought into contact with the corresponding bifurcated insulation piercing contact. For pressing a multitude of conductors in the recesses 22 a particular pressing means for the cable support 15 will be necessary. However, the conductors also can be pressed separately in each of the corresponding recesses 22 and between the tines 5 and 6 by a suitable tooling, the end surface of which is formed as the shown anvil 25.

Apart from the U-shaped portion of the conductor located in the recess 22 the cable support 15 together with the anvil 25, if used, gives an additional strain relief for conductors 16.

Instead of the permanently present cable support 15 and anvils 25, the conductors also may be pressed simultaneously be means of a correspondingly shaped tooling in the recesses 22 and slit 7 of the bifurcated insulation piercing contacts. This particular tooling should be provided with anvils 25 in accordance with the number of recesses in which conductors have to be connected. After applying the conductors this particular tooling can be replaced by cable support 15, from which the anvils 25 can be omitted.

The terminal support 10 comprising the terminals, the terminal cover 14 lowered on the terminal support 10 and the cable support 15 with conductor 16 placed in between can be covered by a dust cover which also may provide additional pressing force between the three plastic parts 10, 14 and 15. This dust cover may be provided with a clamp.

FIG. 7 shows a top view of the terminal cover 14, after introducing the different conductors 16 between the tines of the bifurcated insulation piercing contacts. As distinct from the embodiment of FIG. 6, in the embodiment of FIG. 7 each terminal is provided with two bifurcated insulation piercing contacts. In the top view of FIG. 7 these are shown in interrupted lines. FIG. 7 also shows that three conductors 16 can be located between the usual distance of 2.54 mm between the recesses 11.

FIGS. 8, 9 and 10 respectively show cross sections of terminal cover 14 and terminal support 10 having terminals located in the recesses 11 of the terminal support 10, which terminals are provided with the bifurcated insulation piercing contacts. FIG. 8 shows a cross section over the central row in FIG. 7. FIG. 9 shows a cross section over the upper row in FIG. 10 a cross section over the lower row, seen in the surface of the drawing of FIG. 7.

FIGS. 8, 9 and 10 clearly show that the bifurcated insulation piercing contacts of the center row coincide with the center line of the terminal whereas the bifurcated insulation piercing contacts of the outer rows in FIGS. 9 and 10 are displaced with respect to the center line. This shows that three bifurcated insulation piercing contacts positioned in one row behind each other each can be brought into contact with a separate conductor 16. In this manner three conductors can be guided to the exterior of the contact at one side hereof. These three conductors use the space of one pitch between two recesses 11 in the terminal support 10.

FIGS. 8, 9 and 10 also show how the terminals rest with the shoulders 20 and 8 on the recesses 11 of the terminal support. The barbs 9 form an additional safety means for the terminals.

Figure 11:
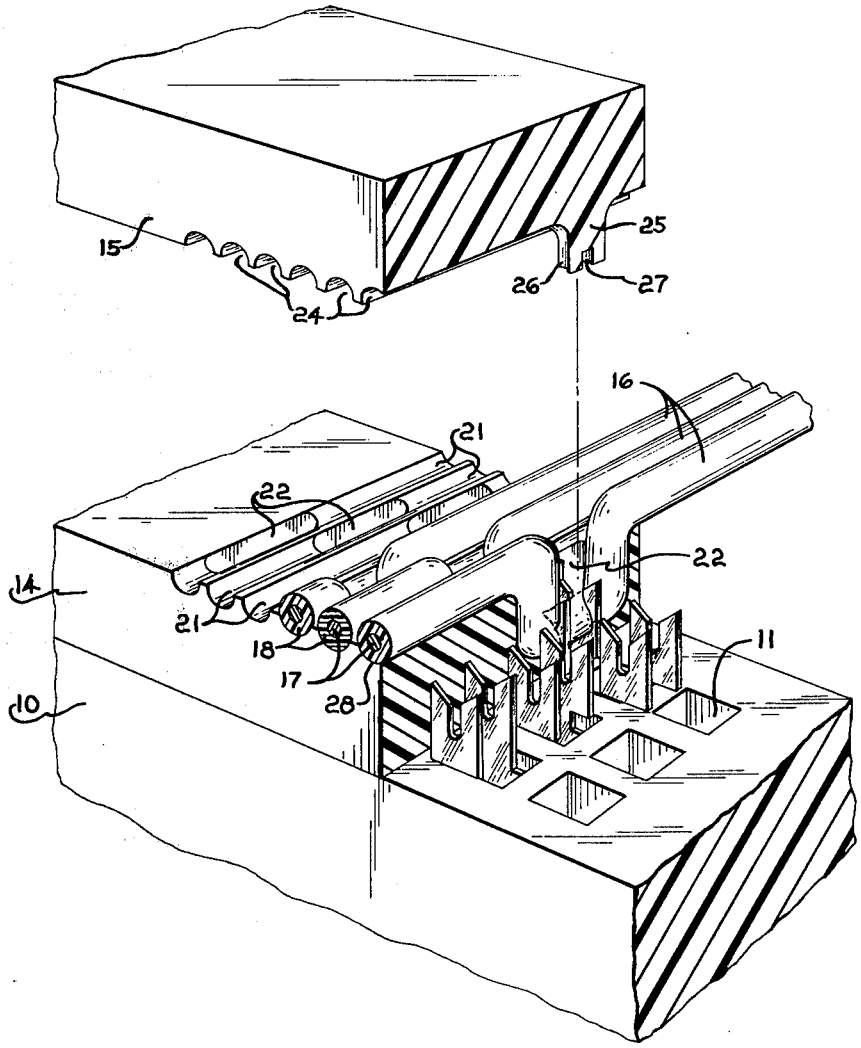
FIGS. 11, 12 and 13 show contact devices according to the present invention and a number of possibilities for applying electrical conductors.

FIGS. 11, 12 and 13 show modified embodiments for applying the conductors 16. In the embodiment of FIG. 11 first the conductors 16 are applied and connected, after which these conductors are cut simultaneously at an edge of the contact device. See reference number 28. In this embodiment the conductors approach the contact device at the upper surface of the terminal cover 14.

As shown in FIG. 11 two bifurcated insulation piercing contacts per terminal are used.

In the embodiment of FIG. 12 the conductors 16 approach from above. Here likewise all conductors are cut simultaneously at 28. In the embodiment of FIG. 13 the conductors also aproach from above, but are cut in a surface of the grooves 21, where the bent portions of the conductors 16 leave the recesses 22.

In case one single conductor has to be repaired or replaced separately, the cable support 15 need only be lifted, after which the conductor to be repaired can be removed by pulling out of recess 22 and out of the bifurcated insulation piercing contact. Thereafter, a new conductor can be applied and connected, after which the cable support 15 can be lowered on the terminal cover again.

The embodiments of FIGS. 11 and 12 are preferred above the embodiment of FIG. 13, because all conductors 16 in the embodiments of FIGS. 11 and 12 can be cut in one cutting operating, in which the cutting surfaces are in line with the side of the contact device. Also upon this cutting operation all conductors 16 are supported, at least in the embodiment of FIG. 11.

Figure 14:
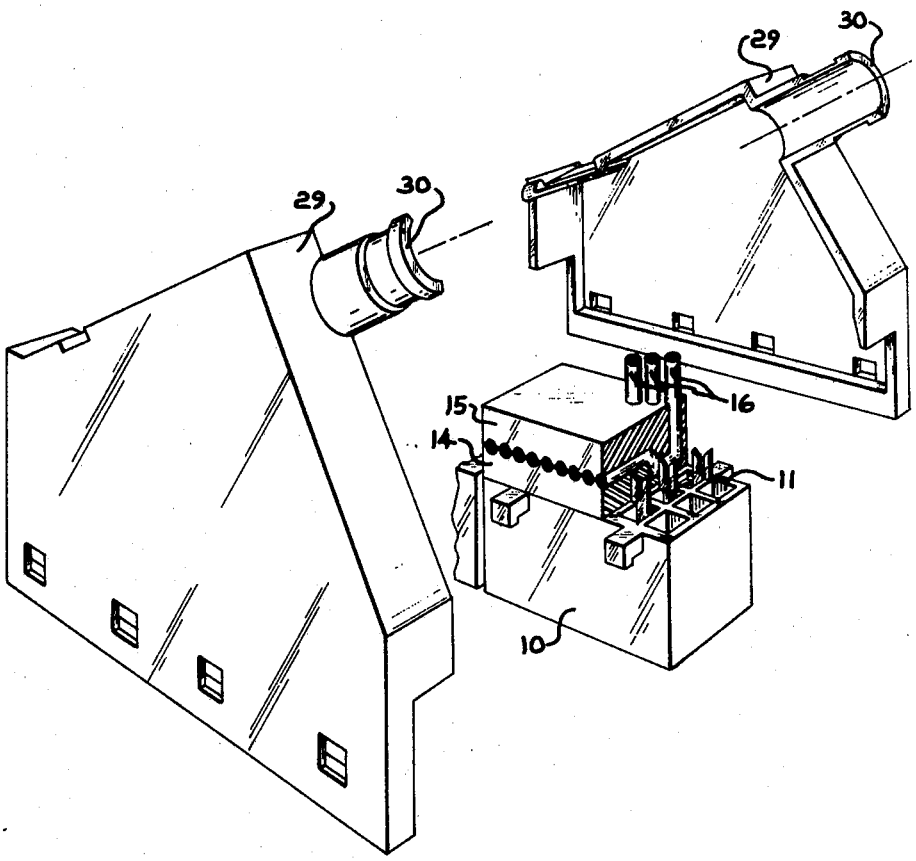
FIG. 14 shows a contact device of the present invention in which a dust cover is used.

In the contact device of FIG. 14 a dust cover is used, consisting of two halves 29. These halves 29 are pressed together and grip around the terminal support 10, terminal cover 14 and cable support 15 and keep these parts clamped together. Conductors 28 are guided out through the shown pipe, also consisting of two halves 30. As a matter of course the number of conductors is not restricted to three as shown.

The embodiment to be practiced depends on the particular circumstances.

The contact device of the present invention can be used with cables of different design. In case of flat cables each conductor or wire needs firstly to be separated. The core 17 can be solid, but also may be a stranded type.

The configuration and dimension of the contact device of the present invention is adapted to a DIN 41612 connector system. However, there is enough design freedom within the scope of the present invention to produce connectors with different dimensional sizes and numbers of positions or recesses in one or more rows.

Also it is self-evident, that the invention is not restricted to a contact device having only three recesses placed behind each other in one row. The invention can be used throughout where space limitations exist caused by high density of connections, conductors and terminals. In the present invention these problems are solved by moving the separate conductors from a flat surface downwardly in the shape of a U, below the upper surface of the terminal cover 14 and pressing the conductors in the lower portion of the recess between the tines of the bifurcated insulation piercing contacts. Between these adjoining bifurcated insulation piercing contacts sufficient insulation exists by turning these bifurcated insulation piercing contacts of the different terminals with respect to the center line of the terminals over 180°. This likewise facilitates the repair of separate conductors.

It is self-evident that the invention is not limited to the shown embodiments, and that modifications and additions are possible without leaving the scope of the present invention.

We claim:

1. In a connector for multiconductor cable having a dielectric terminal support member supporting a multiplicity of terminals, each terminal having at least one bifurcated insulation wire piercing contact with a slit for receiving an insulated conductor at one end and another electrical contact at the other end, a dielectric cable support member, a dielectric terminal cover between said terminal support member and said cable support member and a multiconductor cable retained longitudinally between said terminal cover and said cable support member, the improvement comprising:

(a) mounting the terminals in three rows, two outer and one middle row, the outer rows containing terminals with the slit offset with respect to the center line of the terminal, one outer row of terminals being turned 180° with respect to the other row and the middle row containing terminals with the slit in line with the center line of the terminal, the slits in the terminals of each row being in a plane parallel to the slits in the terminals of adjacent rows, (b) a multiplicity of recesses in a top surface of the terminal cover and a channel from each said recess to an exit in a bottom surface of the terminal cover, each recess accommodating the bifurcated end of a terminal when the terminal cover is mated with the terminal support member and (c) the cable support member maintaining the cable in a U-shaped configuration by a slotted finger extending from a lower surface of the cable support member, the finger having its largest width extending transversely to the plane of the bifurcated insulation piercing contact so that when the connector is closed, one conductor is located within the slit of each terminal.

2. The connector according to claim 1 wherein a multiplicity of slotted fingers extend from a lower surface of said cable support member, each slotted finger corresponding in position to a recess in the terminal cover.

3. Connector according to claim 1 wherein an upper surface of said terminal cover comprises parallel grooves adjacent to each other for at least partly accommodatng insulated electrical conductors.

4. Connector according to claim 1 wherein said cable support member consists of a plate having a lower surface which is supported by the insulated electrical conductors located at the upper surface of the terminal cover, said lower surface having parallel grooves, located adjacent to each other for at least partly accommodating said electrical conductors.

* * * * *